US008631813B2

(12) United States Patent
Ehrenpfordt et al.

(10) Patent No.: US 8,631,813 B2
(45) Date of Patent: Jan. 21, 2014

(54) METHOD FOR PRODUCING A MICROFLUIDIC SYSTEM

(75) Inventors: Ricardo Ehrenpfordt, Korntal-Muenchingen (DE); Mathias Bruendel, Stuttgart (DE); Frieder Haag, Wannweil (DE); Jochen Rupp, Stuttgart (DE); Ulrike Scholz, Korntal (DE)

(73) Assignee: Robert Bosch GmbH, Stuttgart (DE)

( * ) Notice: Subject to any disclaimer, the term of this patent is extended or adjusted under 35 U.S.C. 154(b) by 235 days.

(21) Appl. No.: 13/187,475

(22) Filed: Jul. 20, 2011

(65) Prior Publication Data

US 2012/0024396 A1 Feb. 2, 2012

(30) Foreign Application Priority Data

Jul. 27, 2010 (DE) ..... 10 2010 038 445

(51) Int. Cl.
*F17D 3/00* (2006.01)
*F15C 1/06* (2006.01)
*B01L 3/00* (2006.01)

(52) U.S. Cl.
USPC ..... 137/15.01; 137/833; 422/502; 422/503

(58) Field of Classification Search
CPC ..... F16K 2099/0001; F16K 2099/0073; F16K 2099/78
USPC ..... 137/15.01, 833, 613, 614.03, 884, 137/15.21, 315.09; 422/502, 503, 504
See application file for complete search history.

(56) References Cited

U.S. PATENT DOCUMENTS 6,827,095 B2 * 12/2004 O'Connor et al. ..... 137/15.01
2009/0039496 A1 * 2/2009 Beer et al. ..... 257/693
2009/0179146 A1 * 7/2009 Lomas et al. ..... 250/282

FOREIGN PATENT DOCUMENTS

WO 2005/014452 2/2005

* cited by examiner

*Primary Examiner* — John K Fristoe, Jr.
*Assistant Examiner* — Michael R Reid
(74) *Attorney, Agent, or Firm* — Maginot, Moore & Beck

(57) ABSTRACT

A method for producing a microfluidic system, containing at least one microfluidic component having at least one microfluidically active surface is disclosed. The method includes providing a microfluidic composite substrate having a connection side, comprising at least one microfluidic component introduced into a polymer composition, wherein the microfluidically active surface of said component forms a part of the connection side of the microfluidic composite substrate. The method further includes providing a mating substrate having a connection side for connection to the microfluidic composite substrate. Also, the method includes providing microfluidic structures at least on the connection side of the composite substrate and/or on the connection side of the mating substrate at least for the purpose of forming a microfluidic channel structure in the microfluidic system. In addition, the method includes connecting the microfluidic composite substrate and the mating substrate by their connection sides to form a microfluidic channel structure.

13 Claims, 5 Drawing Sheets

METHOD FOR PRODUCING A MICROFLUIDIC SYSTEM

This application claims priority under 35 U.S.C. §119 to German patent application no. DE 10 2010 038 445.3, filed Jul. 27, 2010 in Germany, the disclosure of which is incorporated herein by reference in its entirety.

BACKGROUND

The present disclosure relates to a method for producing a microfluidic system and also a microfluidic system, in particular produced according to said method, and the use of such a microfluidic system.

Microfluidic systems have developing areas of application in particular in biotechnology, analytical, pharmaceutical and clinical chemistry, environmental analysis and foodstuff chemistry. They are used for example in the form of miniaturized analysis systems, so-called μTAS (Miniaturized Total Analysis System) and also as a lab-on-chip system or as microreactors. Microfluidic systems can be used for example for sample collection, sample preparation, microreaction, separation, detection in active ingredient research, diagnostics analysis and in screening. One advantage of the use of microfluidic systems is the reduction of costs and simplification of handling as a result of the reduction of sample volume and reagent use and consumption. Furthermore, a shorter analysis time and a higher sample throughput are possible.

Microfluidic systems generally consist of glass or polymer substrates in which channels and other passive fluidic elements, such as integrated mixer structures, sample reservoirs, are produced by structuring, for example by means of hot embossing or injection molding. Active elements, such as pumps or actuators and sensors, can be integrated by hybrid integration, for example. In this case, usually in serial methods, prestructured substrates are equipped with individual active components and the latter are then contact-connected.

WO 2005/014452 describes a batch process for producing a semiconductor component with a plastic housing, in which a carrier plate is provided with a thermosensitive adhesive on its top side and this top side is equipped with a multiplicity of individual semiconductor chips. The semiconductor chips are then embedded into a plastic housing composition and the carrier plate is removed by the thermosensitive adhesive being heated. The composite wafer released in this way can then be subjected to redistribution wiring by means of standard thin-film technologies and materials. The pads produced are then provided with solder bumps. The composite wafer can subsequently be separated into individual semiconductor chips.

SUMMARY

The disclosure proposes a method for producing a microfluidic system, containing at least one microfluidic component having at least one microfluidically active surface, at least comprising the following steps:

A) providing a microfluidic composite substrate having a connection side, comprising at least one microfluidic component introduced into a polymer composition, wherein the microfluidically active surface of said component forms at least partially a part of the connection side of the microfluidic composite substrate, B) providing a mating substrate having a connection side for connection to the microfluidic composite substrate, C) providing microfluidic structures at least on the connection side of the composite substrate and/or on the connection side of the mating substrate at least for the purpose of forming a microfluidic channel structure in the microfluidic system, and D) connecting the microfluidic composite substrate and the mating substrate by their connection sides to form a microfluidic channel structure, in particular for producing a fluidic connection of the microfluidic components among one another and/or of a microfluidic component toward the outside.

According to the disclosure, microfluidic components can be, for example, microfluidic chips, such as, by way of example, micropumps, sensors or valves.

According to the disclosure, a microfluidically active surface is understood to be a surface of the microfluidic component which has microfluidic functional elements and/or structures, such as, by way of example, heater structures, sensors, membranes, openings or accesses to microcavities or microchannel structures in the microfluidic component or other microfluidically functional elements or structures.

The method according to the disclosure can advantageously be used to produce microfluidic systems with only slight adaptations using established and standardized processes of construction and connection technology from electronics with a high precision and at the same time with a high throughput. In this case, the method according to the disclosure is cost-effective and furthermore enables mass production of microfluidic systems in a batch process. This is of importance especially also for the area of disposable systems (disposables), for example in point-of-care diagnostics, and advantageously enables economic series production and use on a greater scale.

In one embodiment variant of the method, step A) can in turn comprise the following method steps:

AA) applying at least one microfluidic component to a mounting side of a temporary carrier, wherein the microfluidic component or components is/are placed by the fluidically active surface thereof onto the temporary carrier, AB) coating and enclosing the microfluidic component or components with a polymer composition to form a microfluidic composite substrate, and AC) separating the temporary carrier from the microfluidic composite substrate produced in step B).

In other words, in this method variant, microfluidic components are temporarily positioned on a carrier and connected to the latter. In this case, the components are placed by their microfluidically active surface, which has one or a plurality of fluidic openings, for example, onto the mounting side of the carrier and are then introduced into a suitable polymer composition. In other words, the microfluidic components are embedded into a polymer composition and thus also fixed. By way of example, the embedding of the components into the polymer composition can be effected by encapsulation by injection molding, transfer molding, molding or by casting. As a result of the covering with the temporary carrier, impairment of the microfluidic structures and elements on the microfluidically active surface of the components by the polymer composition can advantageously be avoided to the greatest possible extent in step AB). The microfluidic structures and elements can be membranes, sensors, heater structures and/or fluidic openings, such as, for example, inlets or outlets of microfluidic channels. By way of example, after the polymer composition has at least partly cured, the separation from the temporary carrier can then take place in step AC). With the separation of the composite substrate, the microfluidically active surface placed onto the latter beforehand, for example the fluidic openings of the microfluidic components, is released again.

This method variant according to the disclosure makes it possible surprisingly well for in particular a large number of identical or different microfluidic components to be integrated into composite substrate and to be jointly processed further, in a simple manner. This is advantageously possible without the microfluidic components being impaired, in particular also without impairment of microfluidic structures already present within the microfluidic components, such as, for example, microchannels, micromixer structures, holding structures and reservoirs and/or active elements, such as micropumps, valves, and the functionalities respectively associated therewith.

The temporary carrier can be, in particular, a carrier plate or film which, on its mounting side, is provided with a suitable adhesive for the temporary connection to the microfluidic component or components or can have suitable self-adhesive properties for a temporary fixing of the microfluidic components. In other words, the temporary carrier can have an adhesion layer, for example, on its mounting side. The carrier plate or film can consist of or be formed from, for example, metallic materials, such as, by way of example, steel.

Suitable polymers for the polymer composition for producing the polymeric coating in the composite substrate are, by way of example, molding compositions, epoxy resins, silicone resins, polyester resins, polyurethane resins, thermoplastics, such as polycarbonate (PC), COC, silicones or PMMA, wherein this enumeration should not be understood as exhaustive.

According to the disclosure, it is advantageously likewise possible, alongside the microfluidic components, also to integrate other, for example passive or active, components, such as, for example, semiconductor chips, in the composite substrate instead of joining them together by means of a hybrid integration. This advantageously extends the possible functionalities of the microfluidic systems according to the disclosure.

In step D), a fluidic connection of one or more microfluidic components toward the outside and/or of microfluidic components among one another can be formed by joining and covering the microfluidic composite substrate with a mating substrate prestructured on the connection side thereof.

The mating substrate can be, for example, a glass substrate, a silicon substrate, a printed circuit board substrate or a polymer substrate, in particular a polycarbonate substrate, a Pyrex substrate, a Teflon substrate, a polystyrene substrate, a substrate composed of a cycloolefin copolymer, a polyester substrate or a PDMS substrate.

The structuring of such substrates can be provided for example by established methods for producing components for microsystems technology, such as injection molding, depth etching or embossing, in particular hot embossing.

In one embodiment variant of the method, forming the microfluidic structure in step C) can take place simultaneously with step A) and/or step B), wherein forming the microfluidic structure in the composite substrate comprises providing and using a temporary carrier structured on at least the mounting side.

It is thus possible for the mating substrate already to have a suitable, in particular microfluidic, structuring at least on its connection surface facing the composite substrate. Said structuring can be intended, in particular, for forming a microfluidic channel structure for the fluidic connections of the microfluidic component or components toward the outside and/or of the microfluidic components among one another. However, it is also possible to form and provide further, different microfluidic structures, such as mixer structures and/or holding structures, with the structuring of the mating substrate.

As an alternative or in addition to the use of a prestructured mating substrate, in another configuration of the method according to the disclosure, for example in step AB), in order to produce a fluidic connection toward the outside and/or of the microfluidic components among one another, it is possible to provide a microfluidic structure for forming a microfluidic channel structure in the polymer composition of the composite substrate. In other words, according to the disclosure, the microfluidic structuring in step C) can be effected in a simple manner simultaneously with the production and provision of the composite substrate in step A) and can therefore already be integrated into the composite substrate. Alongside the provision of microfluidic channels for the fluidic connection of the microfluidic components, said structuring can also comprise other passive and/or active microfluidic components such as, for example, chambers, mixer structures, or valves. A further advantage is that the composite substrate can be covered, if appropriate also by a simple unstructured mating plate as mating substrate. This advantageously minimizes the alignment outlay when joining and connecting the substrates.

In a further configuration of the method according to the disclosure, the provision of the microfluidic channel structure in step AB) can be effected by providing and using a temporary carrier structured on at least the mounting side. On the mounting side of the temporary carrier, it is possible in this case to arrange suitable elevations and depressions, for example, which can be molded as it were by the polymer composition in step AB). In this embodiment, therefore, alongside the provided carrier and protection function for the microfluidic components, the temporary carrier equally serves as a molding body (master) for the structuring of the connection surface of the composite substrate.

In further embodiment variants of the method according to the disclosure, providing the temporary carrier structured on the mounting side can take place by a removable material being applied in a structured fashion on the mounting side of the temporary carrier. Alternatively or additionally, the structured application of the removable material can be effected on the microfluidic components placed onto the carrier. In one preferred variant, the removable material can be a die-attach adhesive. Removable material is understood to mean that the latter, in particular after the separation of the composite substrate from the carrier in step AC), for example by means of a solvent and/or thermally, can be removed in such a way that, in particular, the corresponding structuring in the polymer composition of the composite substrate, if appropriate also openings in the microfluidic components, for example, are exposed. Preferably, the removable material can be eliminated in a manner free of residues, but always in such a way that the function of the composite substrate with the microfluidic components contained therein is not impaired.

In an alternative configuration, the structured temporary carrier can have elevations connected permanently to said carrier as structuring on the mounting side. Preferably, the temporary carrier can be configured integrally with the elevated structuring, that is to say the elevations. The structuring thereby mapped and formed on the corresponding surface of the composite substrate can then be released in step AC) according to the disclosure. This has the advantage that no further step is necessary for releasing the structuring and/or the openings present in the microfluidic component. By way of example, the openings can be inlets or outlets of microfluidic channels. Moreover, this method variant has the advantage that the temporary carrier can be repeatedly employed and used, which is favorable particularly for series production on an industrial scale. The temporary carrier can be produced and used as an embossed steel plate, for example. This selection enables particularly precise and dimensionally accurate reproductions even in mass production.

In a further embodiment of the method according to the disclosure, the temporary carrier, prior to being equipped with the microfluidic components in step AA), can be coated over the whole area or in a structured fashion with a removable adhesion layer, for example with a die-attach adhesive film. In this case, the temporary carrier can be embodied in an unstructured fashion with a planar mounting side or in an already structured fashion. This variant according to the disclosure makes it possible to obtain adaptations of the resulting structuring of the composite substrate in a simple manner. At the same time, the adhesion layer can be utilized for temporarily fixing the components on the temporary carrier.

In the context of another configuration of the method according to the disclosure it may be provided that in step A), in addition to the at least one microfluidic component, at least one electronic component, in particular a semiconductor chip, is introduced, that is to say embedded and fixed, into the polymer composition.

In a further embodiment of the method, before or after step D), an electrical redistribution wiring and/or electrical contact-connection of the semiconductor chips and/or of the microfluidic components can take place. This advantageously makes it possible to provide the necessary and/or desired electrical signal and current paths and also contact-connections both of semiconductor chips and of microfluidic components.

In the context of another method variant according to the disclosure, before step D), at least one further microfluidic component and/or an electronic component, in particular a semiconductor chip, can advantageously be arranged on the connection side of the composite substrate.

In a further configuration of the method according to the disclosure, providing the mating substrate in step B) can comprise introducing, that is to say embedding and fixing, at least one microfluidic component into a polymer composition. In other words, the mating substrate can also be a composite substrate.

In the context of another embodiment of the method according to the disclosure, furthermore, it can comprise introducing fluidic through-contacts into the composite substrate and/or the mating substrate. As a result, fluidic connections of one or more microfluidic components toward the outside can also be provided simultaneously in one method step.

The disclosure furthermore relates to a microfluidic system, in particular produced according to the method described above, containing at least one microfluidic component having at least one microfluidically active surface, wherein the at least one microfluidic component is embedded and fixed into a polymer composition to form a microfluidic composite substrate and the microfluidically active surface of the microfluidic component forms a part of a connection side of the microfluidic composite substrate and the composite substrate is provided with a cover on the connection side by connection to a mating substrate, wherein furthermore, in particular between the composite substrate and the mating substrate, microfluidic structures are formed, in particular for the fluidic connection of the microfluidic component toward the outside and/or of microfluidic components among one another.

In one embodiment, the microfluidically active surface of the microfluidic components can comprise one or a plurality of fluidically active membranes, sensor areas, heater structures and/or openings of channel structures. According to the disclosure, the microfluidic structures can be or comprise microfluidic channels, but also chambers, mixer structures, valves, pumps and/or other passive and/or active components.

In one configuration, the microfluidic system according to the disclosure can comprise at least one electronic component, in particular a semiconductor chip. The electronic component can advantageously be provided for detecting physical properties of a fluid, or the associated measurement values, and/or for setting operating parameters of the fluid in the microfluidic system. Furthermore, an electronic component can have transmitting and/or receiving means for exchanging electronic signals and data with external components. The external component can be a computer, for example.

Furthermore, the present disclosure relates to the use of a microfluidic system according to the disclosure in particular in an integrated microfluidic lab-on-chip system, a μTAS or a microreactor. These can be used for example in medical technology, microbiology and/or in medical, biotechnological analysis. One advantage of the use of such microfluidic systems is the reduction in costs and the simplification of handling as a result of the reduction of sample volume and reagent use and consumption and also the reduction in costs as a result of the simple production according to the disclosure and the possible series production. In addition, a shorter analysis time and a higher sample throughput can advantageously be obtained.

BRIEF DESCRIPTION OF THE DRAWINGS

Further advantages and advantageous configurations of the subjects according to the disclosure are illustrated by the drawings and explained in the description below. In this case, it should be taken into consideration that the drawings only have descriptive character and are not intended to restrict the disclosure in any form.

DETAILED DESCRIPTION

Figure 1A:
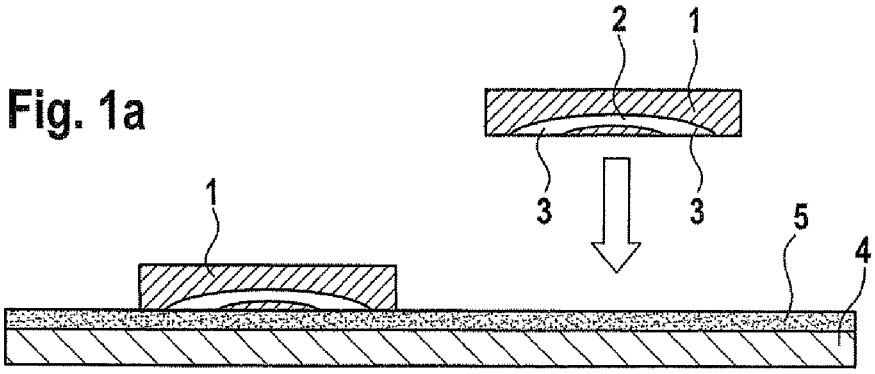
FIG. 1 shows, in schematic sectional illustrations a) to d), the production of a microfluidic system according to the disclosure with a prestructured mating substrate as cover.
Figure 1B:
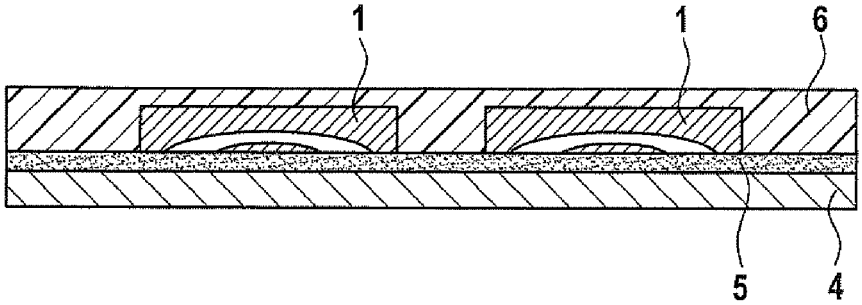
Figure 1C:
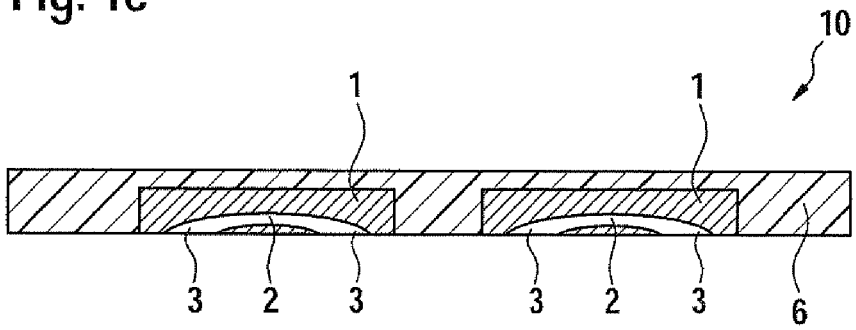
Figure 1D:
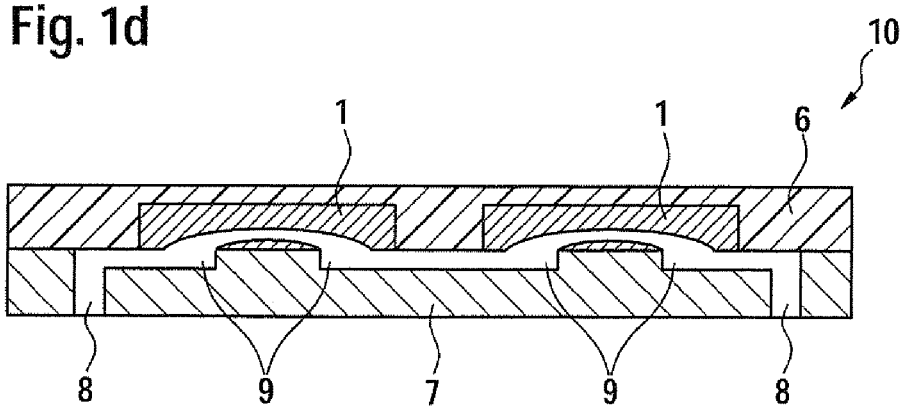

FIGS. 1*a* to 1*d* show a first configuration of a microfluidic system according to the disclosure, and of a method according to the disclosure for producing a microfluidic system. In this case, FIG. 1*a* shows, in a schematic sectional illustration, two microfluidic components 1 each having a microfluidic channel 2 with microfluidic openings 3 on their microfluidically active surface, for example an inlet and an outlet. In step AA) of the method according to the disclosure, the microfluidic components 1 are placed by their microfluidically active surface, in which the openings 3 are arranged, onto a temporary carrier 4, which has an adhesion layer 5 on its mounting side, in the arrow direction and are connected to the temporary carrier 4. The temporary carrier 4 can be a plane-parallel plate, for example. By way of example, the temporary carrier 4 can be a steel plate. In FIG. 1*b*, the microfluidic components 1 are embedded into a polymer composition 6. In step AB) of the method, the components 1 placed on the temporary carrier 4 and connected to the carrier 4 by means of the adhesion layer 5 can, for example, be encapsulated by injection molding or molded with the polymer composition 6 or alternatively be cast therein. Advantageously, by virtue of the connection to the temporary carrier 4, the openings 3 are protected against the ingress of the polymer composition 6 and are kept free. FIG. 1*c* shows the composite substrate 10 composed of polymer composition 6 and microfluidic components 1, which has been separated from the temporary carrier 4 with the adhesion layer 5 in step AC) of the method according to the disclosure. In this step, the openings 3 of the microfluidic components 1 are freed again. The freed surface of the composite substrate 10 forms the connection side of the composite substrate 10. In FIG. 1*d*, the composite substrate 10 is connected to a mating substrate 7 as cover. In this embodiment, the mating substrate 7 is provided in an already prestructured fashion in order to produce fluidic connections on its connection side. The structured connection side of the mating substrate 7 is joined with the composite substrate 10 and connected by adhesive bonding, for example. Before the connection of composite substrate 10 and mating substrate 7, for example, an electrical redistribution wiring can additionally be provided according to the disclosure. The prestructuring of the mating substrate 7 comprises fluidic through-contacts 8 for fluidically connecting the microfluidic components toward the outside, for example to components lying outside the microfluidic system. The prestructuring of the mating substrate 7 additionally comprises microfluidic structures, in particular for forming channel structures, on the connection side. With these structures, with the connection of composite substrate and mating substrate 7, a microfluidic channel structure 9 is formed in the microfluidic system, which channel structure can serve for connection to the fluidic through-contacts 8 and for the fluidic connection of the microfluidic components 1 among one another. According to the disclosure, further microfluidic structures and components such as holding structures, chambers, micromixers, pumps and/or valves can also be formed.

Figure 2A:
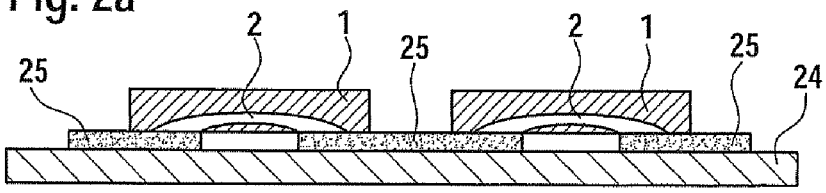
FIG. 2 shows, in schematic sectional illustrations a) to d), the production of a microfluidic system according to the disclosure with a layer of a removable material applied to a temporary carrier in a structured fashion.
Figure 2B:
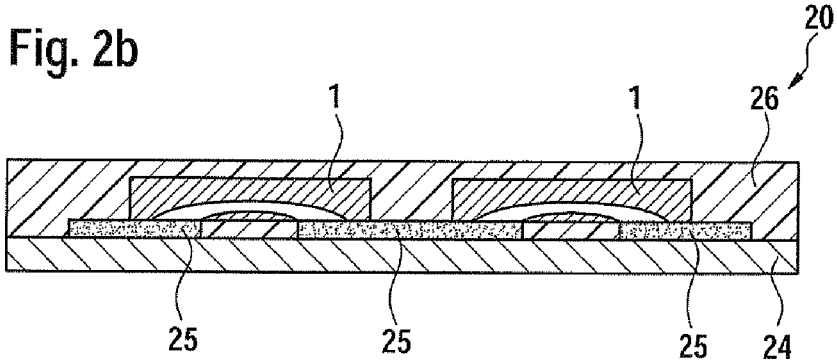
Figure 2C:
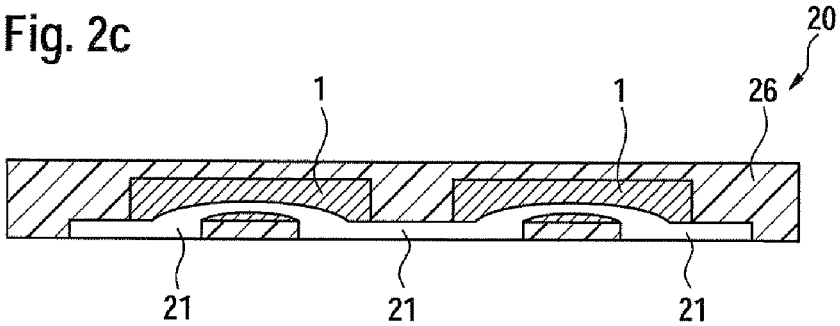
Figure 2D:
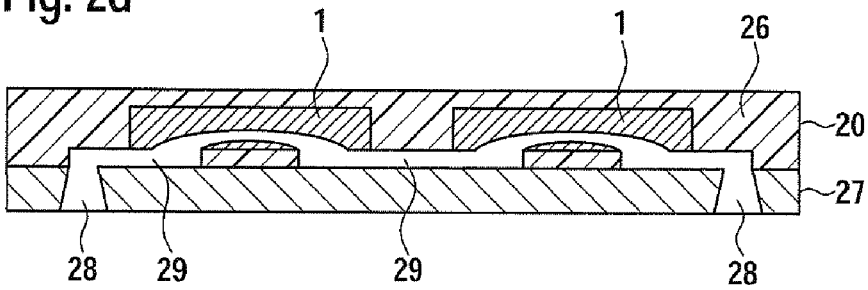

FIGS. 2*a* to 2*d* show a second configuration of a microfluidic system according to the disclosure, and of a method according to the disclosure for producing a microfluidic system. FIG. 2*a* shows, in a schematic sectional illustration, two microfluidic components 1 each having a microfluidic channel 2 with openings 3. The microfluidic components 1 are placed by their microfluidically active surface with the openings 3 onto a structured temporary carrier 24 and connected to the latter. The temporary carrier 24 is structured by an adhesion layer 25 applied in a structured fashion. The structured adhesion layer 25 is formed from a removable material, for example. By way of example, the material of the adhesion layer may be releasable using solvents and/or thermally. A variable and adaptable structuring of the temporary carrier 24 can thereby be obtained in a simple manner. FIG. 2*b* shows the arrangement shown in FIG. 2*a*, wherein the microfluidic components 1 are in this case embedded into a polymer composition 26 to form a composite substrate 20. The composite substrate 20 is formed in method step AB) according to the disclosure for example by encapsulation by injection molding, transfer molding, molding or casting with the polymer composition 26. FIG. 2*c* shows, in a sectional illustration, the composite substrate 20 separated from the temporary carrier 24. As a result of the removal of the structured adhesion layer 25 in the composite substrate 20, integrated microfluidic structures 21 are formed in the polymer composition 26. In other words, microfluidic structures 21, in particular for forming a microfluidic channel structure 29, in the microfluidic system (FIG. 2*d*) can already be integrated in the composite substrate 20. The microfluidic channels of the channel structure 29 can serve for fluidically connecting the microfluidic components 1 toward the outside and/or microfluidic components 1 among one another. FIG. 2*d* additionally shows the composite substrate 20 from FIG. 2*c* with a mating substrate 27 connected thereto as a cover. In this embodiment, the mating substrate 27 has fluidic through-contacts 28. At least one portion of the through-contacts 28 can be contact-connected to the microfluidic channel structure 29.

Figure 3A:
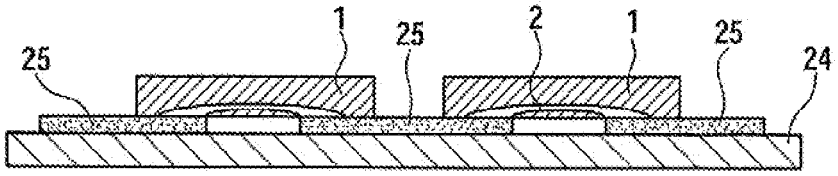
FIG. 3 shows, in schematic sectional illustrations a) to d), the production of a microfluidic system according to the disclosure with an unstructured mating substrate as cover.
Figure 3B:
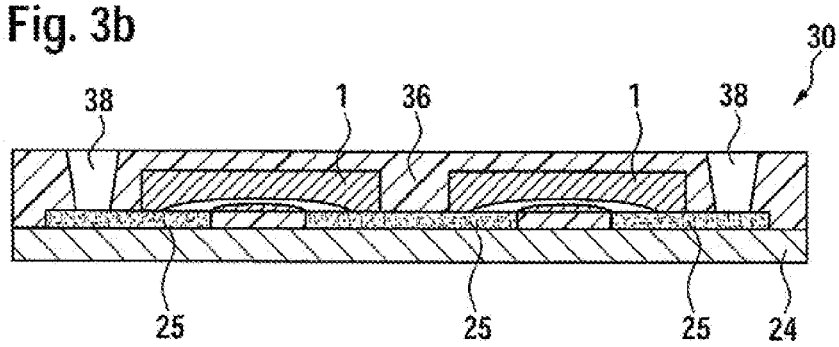
Figure 3C:
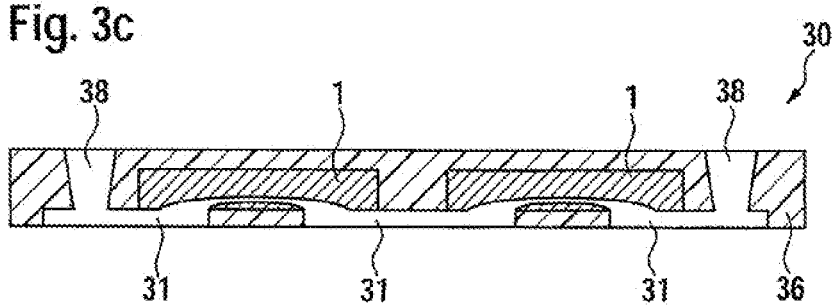
Figure 3D:
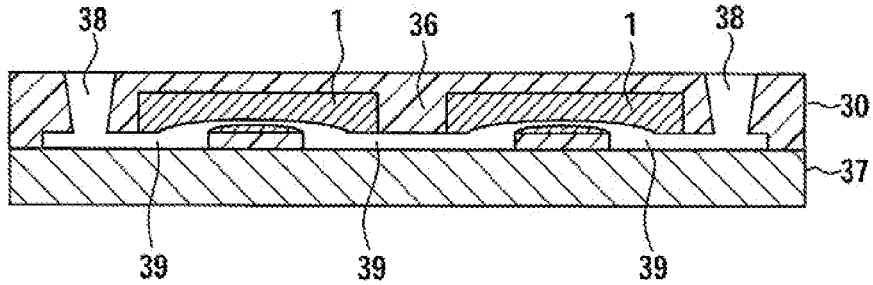

FIGS. 3*a* to 3*d* show a third embodiment of a microfluidic system according to the disclosure, and of a method according to the disclosure for producing a microfluidic system. In this case, FIG. 3*a* corresponds to the arrangement shown in FIG. 2*a*. FIG. 3*b* shows the arrangement from FIG. 3*a*, wherein the microfluidic components 1 are embedded into a polymer composition 36 to form a composite substrate 30, wherein the composite substrate 30 is connected to the temporary carrier 24. In addition, fluidic through-contacts 38 are formed in the polymer composition 36. Said through-contacts 38 can advantageously already be concomitantly shaped and provided during the embedding of the microfluidic components 1 into the polymer composition 36 in step AB) of the method according to the disclosure. Alternatively, the fluidic through-contacts 38 can also be produced by subsequent processing, for example by drilling. FIG. 3*c* shows, in a sectional illustration, the composite substrate 30 separated from the temporary carrier 24. The microfluidic structures 31 freed by the removal of the structured adhesion layer 25 in the composite substrate 30 are embodied as depressions in the polymer composition 36. In other words, microfluidic structures 31, for example for forming a microfluidic channel structure 39, can already be integrated in the composite substrate 30. The channels of the microfluidic channel structure 39 can serve for fluidically connecting the microfluidic component or components 1 toward the outside and/or microfluidic components 1 among one another. At least one portion of the channels of the channel structure 39 is contact-connected to the fluidic through-contacts 38. FIG. 3*d* shows that the covering of the composite substrate 30 in this configuration of the disclosure can advantageously be effected by joining and connection to an unstructured mating substrate 37. The mating substrate 37 can be a planar plate, for example. This facilitates, inter alia, the alignment outlay during the joining process.

Figure 4A:
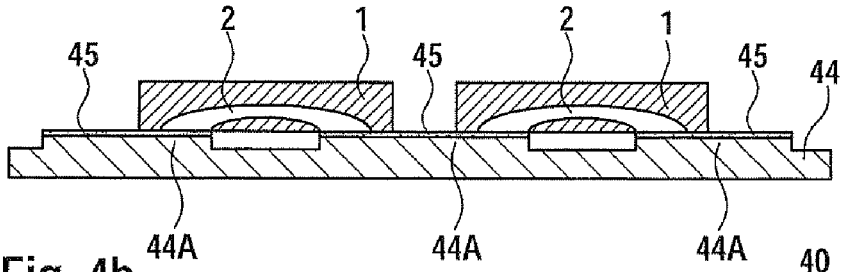
FIG. 4 shows, in schematic sectional illustrations a) to d), the production of a microfluidic system of the disclosure using a structured temporary carrier.
Figure 4B:
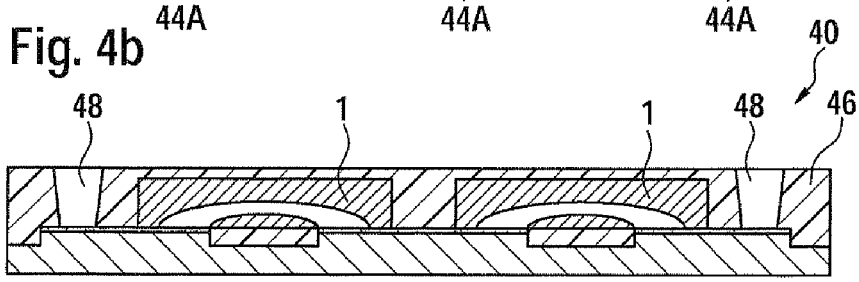
Figure 4C:
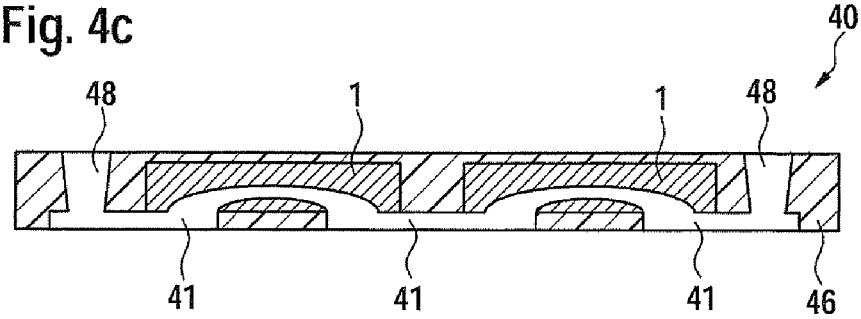
Figure 4D:
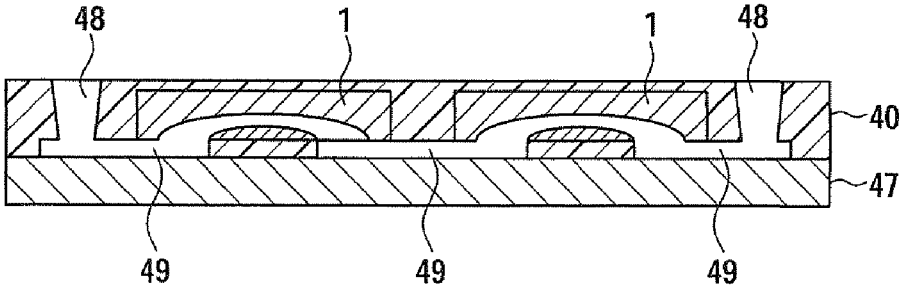

FIGS. 4*a* to 4*d* show a fourth embodiment of a microfluidic system according to the disclosure, and of a method according to the disclosure for producing a microfluidic system. In this case, FIG. 4*a* shows, in a schematic sectional illustration, two microfluidic components 1 each having a microfluidic channel 2 with openings 3. The microfluidic components 1 are placed by their microfluidically active surface, in which the openings 3 are arranged, on a structured temporary carrier 44 and are connected thereto. The temporary carrier 44 has elevations 44A, which can be permanently connected to the carrier 44. The temporary carrier 44 can be a milled steel plate, for example, which can advantageously be repeatedly used for a method according to the disclosure. This is favorable particularly with regard to series production of microfluidic systems. In this embodiment, an adhesion layer 45 is applied on the elevations 44A, the microfluidic components 1 temporarily being fixed by means of said adhesion layer. The adhesion layer 45 can be formed from a removable material, for example from a die-attach adhesive. FIG. 4*b* shows the arrangement from FIG. 4*a*, wherein the microfluidic components 1 are embedded into a polymer composition 46 to form a composite substrate 40. In addition, fluidic through-contacts 48 are already formed in the polymer composition 46. The through-contacts 48 can advantageously already be concomitantly shaped in step AB) of the method according to the disclosure. Alternatively, the fluidic through-contacts 48 can also be produced by subsequent processing, for example by drilling. FIG. 4*c* shows, in a sectional illustration, the composite substrate 40 separated from the temporary carrier 44. The microfluidic structures 41 shaped by the structured carrier 44 with its elevations 44*a* in the composite substrate 40 are embodied as depressions in the polymer composition 46 since the composite substrate 40 is kept free of the polymer composition 46 there during its formation. In other words, microfluidic structures 41, for example for forming channels of a microfluidic channel structure 49 in the microfluidic system for fluidically connecting the component or components 1 toward the outside and/or microfluidic components 1 among one another, can be at least partly integrated in the composite substrate 40. At least one portion of the channels of the channel structure 49 can be contact-connected to the fluidic through-contacts 48. FIG. 4*d* shows that the covering of the composite substrate 40 in this configuration of the disclosure can be effected by joining and connection to an unstructured mating substrate 47. This advantageously minimizes the alignment outlay during the joining process.

What is claimed is:

1. A method for producing a microfluidic system, containing at least one microfluidic component having at least one microfluidically active surface, comprising:

A) providing a microfluidic composite substrate having a connection side, comprising at least one microfluidic component introduced into a polymer composition, the microfluidic component defining a microfluidic component channel structure and including a microfluidically active surface on one side of the microfluidic component that defines a plurality of openings fluidly connected to each other via the microfluidic component channel structure, the plurality of openings in the microfluidically active surface being the only openings to the microfluidic component channel, wherein the microfluidically active surface of said component forms a part of the connection side of the microfluidic composite substrate such that the plurality of openings are exposed on the connection side of the microfluidic composite substrate;

B) providing a mating substrate having a connection side for connection to the microfluidic composite substrate;

C) providing microfluidic structures on a connection side of at least one of the composite substrate in the polymer composition and the mating substrate that define a microfluidic substrate channel structure in the microfluidic system; and D) connecting the microfluidic composite substrate and the mating substrate by their connection sides to form the microfluidic substrate channel structure such that the microfluidic substrate channel structure fluidly connects the plurality of openings in the microfluidically active surface to fluidic-through contacts that are configured to fluidly connect the microfluidic components to components outside the microfluidic system.

2. The method according to claim 1, wherein providing the microfluidic composite substrate in step A) comprises:

AA) applying at least one microfluidic component to a mounting side of a temporary carrier, wherein the microfluidic component or components is/are placed by the fluidically active surface thereof onto the temporary carrier, AB) coating and enclosing the microfluidic component or components with a polymer composition to form the microfluidic composite substrate, and AC) separating the temporary carrier from the microfluidic composite substrate produced in step AB).

3. The method according to claim 1, wherein forming the microfluidic structure in step C) takes place simultaneously with at least one of step A) and step B), wherein forming the microfluidic structure in the composite substrate comprises providing and using a temporary carrier structured on at least the mounting side.

4. The method according to claim 3, wherein providing the temporary carrier structured on the mounting side takes place by a removable material being applied in a structured fashion on the mounting side of the temporary carrier.

5. The method according to claim 4, wherein a die-attach adhesive is used as the removable material.

6. The method according to claim 3, wherein the structured temporary carrier has elevations connected permanently to said carrier as structuring on the mounting side.

7. The method according to claim 2, wherein the temporary carrier, prior to being equipped with the microfluidic component or components in step AA), is coated over the whole area or in a structured fashion with a removable adhesion layer.

8. The method according to claim 1, wherein before step D), at least one further microfluidic component is arranged on the connection side of the composite substrate.

9. The method according to claim 1, wherein providing the mating substrate in step B) comprises introducing at least one microfluidic component into a polymer composition.

10. The method according to claim 1, further comprising introducing the fluidic through-contacts into the polymer composition of the composite substrate and/or the mating substrate.

11. A microfluidic system comprising:

a microfluidic composite substrate including at least one microfluidic component introduced into a polymer composition, the composite substrate having a connection side, the at least one microfluidic component defining a microfluidic component channel structure and having at least one microfluidically active surface on one side of the at least one microfluidic component that defines a plurality of openings fluidly connected to each other via the microfluidic component channel structure, the microfluidically active surface including the plurality of openings being exposed on the connection side of the composite substrate, a mating substrate having a connection side joined to the connection side of the composite substrate and extending over the at least one microfluidically active surface, wherein at least one of the composite substrate and the mating substrate defines fluidic through-contacts that are laterally offset from the microfluidic components and are configured to fluidly connect the microfluidic components to components outside the microfluidic system, and wherein, between the composite substrate and the mating substrate, a microfluidic substrate channel structure is formed that fluidly connects the plurality of openings in the microfluidically active surface to the fluidic through-contacts.

12. A microfluidic system according to claim 11, wherein the microfluidically active surface of the at least one microfluidic component includes a fluidically active membrane.

13. The method of claim 1, wherein the at least one microfluidic component comprises at least two microfluidic components, each of the at least two microfluidic components defining a microfluidic component channel structure and including a microfluidically active surface on one side of the microfluidic component that defines a plurality of openings fluidly connected to each other via the microfluidic component channel structure, wherein the microfluidically active surface of each of the at least two components forms a part of the connection side of the microfluidic composite substrate such that the plurality of openings of each of the components are exposed on the connection side of the microfluidic composite substrate, and wherein the microfluidic substrate channel structure fluidly connects the openings in the microfluidically active surface of each microfluidic component to the openings in the microfluidically active surface of the other microfluidic components.

* * * * *